US007104481B2

(12) United States Patent
Schenker

(10) Patent No.: US 7,104,481 B2
(45) Date of Patent: Sep. 12, 2006

(54) COMBINATION CABINET AND SHREDDER

(75) Inventor: David A. Schenker, Cedarburg, WI (US)

(73) Assignee: Innovative Storage Designs, Inc., Mequon, WI (US)

( * ) Notice: Subject to any disclaimer, the term of this patent is extended or adjusted under 35 U.S.C. 154(b) by 0 days.

(21) Appl. No.: 10/972,733

(22) Filed: Oct. 25, 2004

(65) Prior Publication Data

US 2006/0086847 A1 Apr. 27, 2006

(51) Int. Cl.
*B02C 18/16* (2006.01)

(52) U.S. Cl. ..... 241/100; 241/101.2; 241/236; 312/237

(58) Field of Classification Search ..... 312/237; 241/100, 236, 101.2
See application file for complete search history.

(56) References Cited

U.S. PATENT DOCUMENTS 3,650,226 A * 3/1972 Conroy et al. ..... 109/25
4,637,560 A 1/1987 Goldhammer
4,754,933 A * 7/1988 Leuthold et al. ..... 241/57
4,873,811 A 10/1989 Izumitani et al.
4,957,243 A 9/1990 Kanagaki et al.
5,020,733 A 6/1991 Strohmeyer
5,035,366 A 7/1991 Hashimoto et al.
5,269,473 A * 12/1993 Strohmeyer et al. ..... 241/100
5,375,781 A 12/1994 Schwelling
5,429,313 A * 7/1995 Schwelling ..... 241/36
5,934,584 A 8/1999 Schwelling
5,975,445 A 11/1999 Ko
6,079,645 A * 6/2000 Henreckson et al. ..... 241/37.5
6,390,397 B1 5/2002 Ko
6,491,245 B1 12/2002 Rajewski
D477,016 S 7/2003 Lee

FOREIGN PATENT DOCUMENTS

DE 19937170 A1 * 2/2001

* cited by examiner

*Primary Examiner*—Mark Rosenbaum
(74) *Attorney, Agent, or Firm*—Andrus, Sceales, Starke & Sawall, LLP

(57) ABSTRACT

A combination including a cabinet and a shredder. The cabinet including a cabinet housing having a top, a front, a back and two sides, a drawer supportable by the cabinet housing and operable to selectively support materials therein, the drawer being movable between an open position and a closed position and the shredder being supported by the cabinet housing and at least partially positioned within the cabinet housing, the shredder having an inlet for materials to be fed into the shredder to be shredded to form shredded material and an outlet through which shredded material is dispensed.

21 Claims, 2 Drawing Sheets

COMBINATION CABINET AND SHREDDER

FIELD OF THE INVENTION

This invention relates to cabinets and shredders and, more particularly, to a combination file cabinet and shredder.

BACKGROUND OF THE INVENTION

Paper shredders are commonly placed on an office floor or stacked on desks, book shelves or other office furniture or cabinets along with printers, fax machines or other office equipment. Such stacking or other placement of office equipment is commonly unsightly and inefficient.

In other arrangements, paper shredders have been placed on cabinets having pivotal doors. The pivotal doors provide access to the interior of the device where a collection bag is supported for collection of shredded material from the shredder. The sole function of the cabinet is to support the collection bag therein. In such an instance, efficient use of the office space is not achieved because the device is occupying the same or more office space than the shredder and is not providing any additional capabilities.

SUMMARY OF THE INVENTION

In some aspects, the invention provides a combination including a cabinet having a cabinet housing including a top, a front, a back and two sides, a drawer supportable by the cabinet housing and operable to selectively support materials therein, the drawer being movable between an open position and a closed position, and a shredder supported by the cabinet housing, the shredder being at least partially positioned within the cabinet housing and the shredder having an inlet for materials to be fed into the shredder to be shredded to form shredded material and an outlet through which shredded material is dispensed.

In some aspects, the invention provides a combination including a cabinet having a cabinet housing including a top, a front, a rear and two sides, a shredder support in the top of the cabinet housing, a file drawer supported by the cabinet housing and operable to support files therein, the drawer being movable between a closed position and an open position, and a shredder having a shredder housing supported by the shredder support on the top of the cabinet housing, the top of the cabinet housing having a first depth in the direction from the front to the rear and the shredder housing having a second depth in the direction from the front to the rear, the first depth being at least two times the second depth, an inlet defined in the shredder housing and an outlet defined in the shredder housing, the outlet opening discharging shredded material into the cabinet housing.

In some aspects, the invention provides a combination including a cabinet having a cabinet housing including a top surface, a rear surface and two side surfaces, and a drawer supported by the cabinet housing and being movable between a closed position, in which the drawer is positioned substantially within the cabinet housing, and an open position, in which the drawer is positioned substantially outside the cabinet housing, a shredder supportable by the cabinet housing and including a shredder housing, an inlet defined in the shredder housing for feeding materials into the shredder to be shredded, and an outlet defined in the shredder housing from which materials are dispensed after being shredded, the outlet being positioned internally of the cabinet housing, and a receptacle supportable by the drawer for receiving material shredded by the shredder, the receptacle being positioned substantially underneath the outlet when the drawer is in the closed position and not being positioned underneath the outlet when the drawer is in the open position.

Independent features and independent advantages of the present invention will become apparent to those skilled in the art upon review of the following detailed description, claims and drawings.

Figure 1:
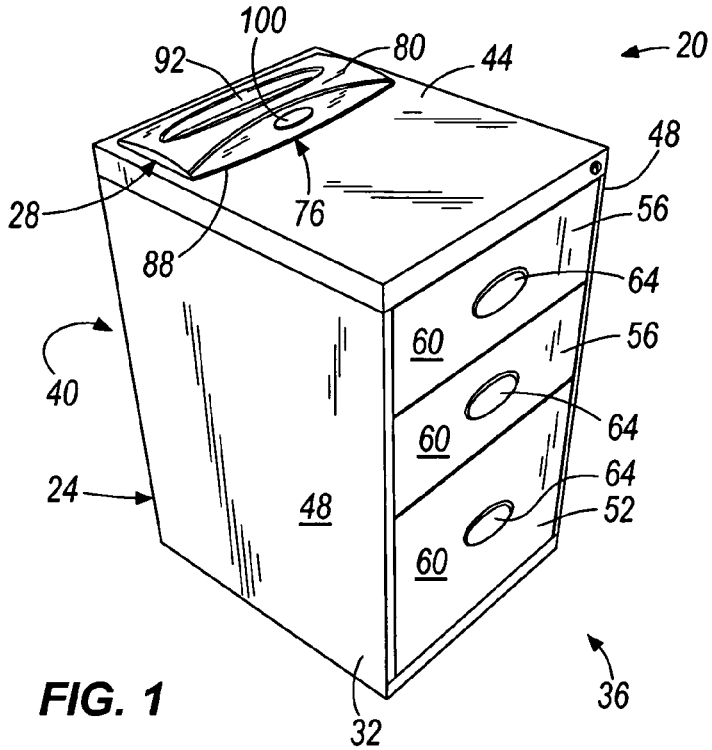
FIG. 1 is a top perspective view of a device embodying aspects of the present invention.

Before at least one embodiment of the invention is explained in detail, it is to be understood that the invention is not limited in its application to the details of the construction and arrangements of the components set forth in the following description or illustrated in the drawings. The invention includes other embodiments and can be practiced or carried out in various ways. Also, it is understood that the phraseology and terminology used herein is for the purpose of description and should not be regarded as limiting. The use of "including," "comprising," or "having" and variations thereof is meant to encompass the items listed thereafter and equivalents thereof as well as additional items. Unless limited otherwise, the terms "connected," "coupled," and variations thereof herein are used broadly and encompass direct and indirect connections and couplings. In addition, the terms "connected" and "coupled" and variations thereof are not restricted to physical or mechanical connections or couplings.

Although references may be made below to directions, such as left, right, up, down, top, bottom, front, rear, back, etc., in describing the drawings, these references are made relative to the drawings (as normally viewed) for convenience. These directions are not intended to be taken literally or limit the present invention in any form.

DETAILED DESCRIPTION

FIG. 1 illustrates a device 20 embodying aspects of the present invention. In the illustrated construction, the device 20 is a combination file cabinet 24 and shredder 28. The shredder 28 is selectively removable from the file cabinet 24 (see FIG. 4).

The file cabinet 24 includes a cabinet housing 32 having a front 36, a rear 40, a top 44, and two sides 48. A file drawer 52 and a pair of smaller drawers 56 are supported by the cabinet housing 32 and are moveable between an open position, in which the drawer is pulled out from the front of the cabinet housing 32 and is positioned substantially outward of the cabinet housing 32 (see file drawer 52 in FIG. 4), and a closed position, in which the drawer is positioned substantially within the cabinet housing 32 and a front plate 60 of the drawer is substantially flush with the front of the file cabinet 24 (see all drawers 52, 56 in FIG. 1). In the illustrated construction, the file cabinet 24 includes three drawers, one file drawer 52 and two smaller drawers 56; however, it should be understood that the file cabinet 24 can include any number of drawers in any combination of file drawers, smaller drawers, or other types of drawers. Each drawer 52, 56 includes a handle 64 graspable by a user to move the drawers 52, 56 between the closed position and the open position. The drawers 52, 56 are capable of selectively supporting a variety of office materials, such as, for example, files, documents, envelopes, writing utensils, staplers, and other office supplies. In the illustrated construction, the file drawer 52 is preferably configured to support files therein and, more preferably, support hanging files 66 therein (see FIG. 4).

Figure 2:
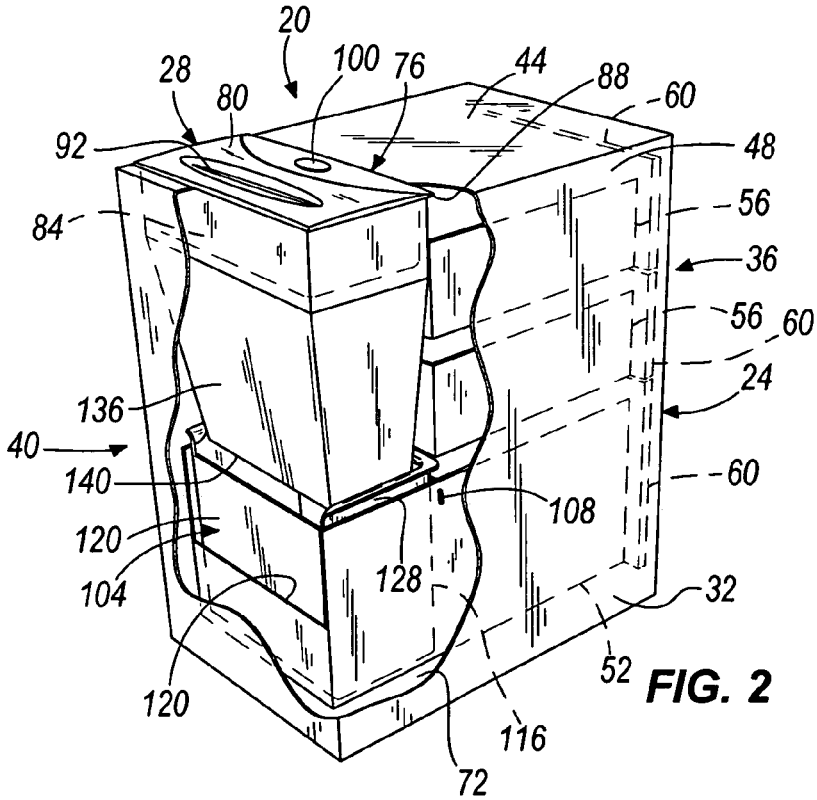
FIG. 2 is a partially-broken rear perspective view of the device shown in FIG. 1.

With reference to FIGS. 1 and 2, the cabinet housing 32 supports the shredder 28 on the top 44 thereof. An aperture, frame or shredder support 68 is defined in the top 44 of the cabinet housing 32 and communicates with an interior 72 of the cabinet housing 32. In the illustrated construction, the aperture 68 is defined near the rear of the cabinet 24. It should be understood that the aperture 68 can be defined in any portion of the top 44 of the cabinet housing 32 and still be within the spirit and scope of the present invention. The shredder 28 includes a shredder housing 76 having an exposed upper housing portion 80 and a lower housing portion 84. The upper housing portion 80 includes a flange 88 engagable with the top 44 of the cabinet housing 32 to vertically support the shredder 28 on the file cabinet 24. The flange 88 is sized larger than the aperture 68 to prevent the shredder 28 from falling into the interior 72 of the cabinet housing 32 when the shredder 28 is placed on the file cabinet 24. The lower housing portion 84 of the shredder 28 passes through the aperture 68 and is positionable within the interior 72 of the cabinet housing 32 when the shredder 28 is supported on the top 44 of the file cabinet 24.

An inlet 92 is defined in the exposed upper housing portion 80 to allow a user to easily feed materials into the shredder 28 from the exterior of the file cabinet 24 and an outlet (not shown) is defined in the lower housing portion 84 and is positioned within the interior 72 of the cabinet housing 32. The inlet 92 and outlet are in communication with each other in such a manner that allows materials to be fed into the inlet 92, pass through and be shredded by any of a variety of conventional shredding components within the shredder 28, and be discharged from the shredder 28 through the outlet. The shredder 28 further includes a control portion 100 manipulatable by a user to control various settings of the shredder 28, such as, for example automatic shred, shredding capacity, shredding speed, forward and reverse feeding directions and on/off capabilities.

Figure 3:
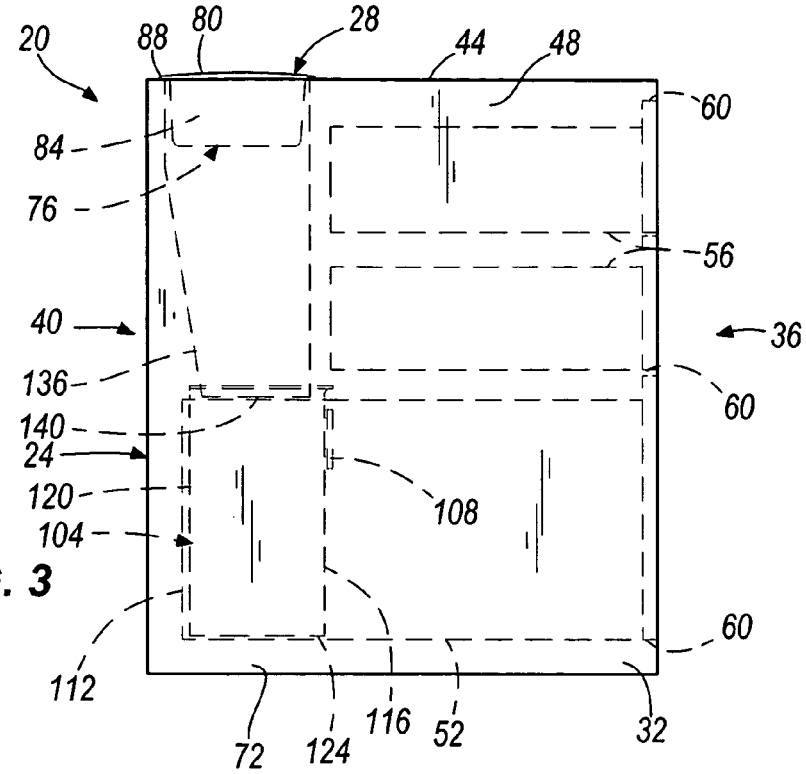
FIG. 3 is a side view of the device shown in FIG. 1.
Figure 4:
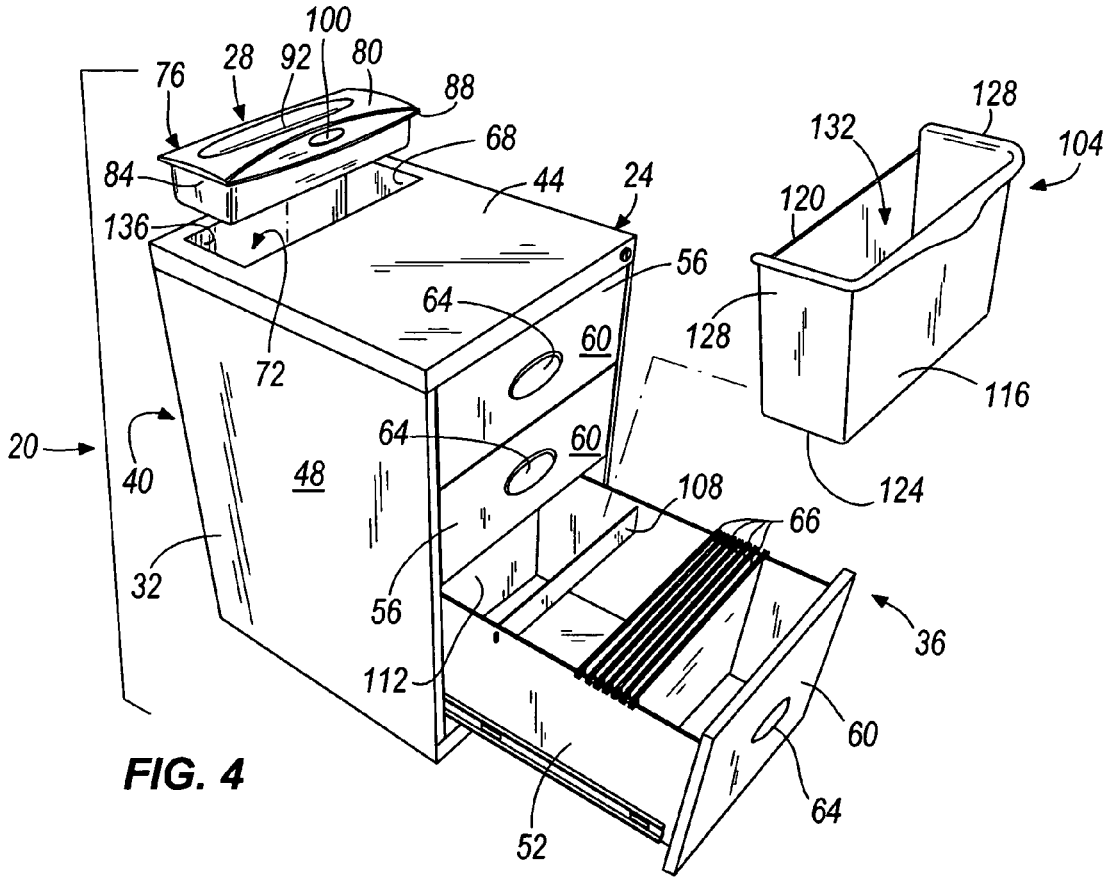
FIG. 4 is a partially-exploded top perspective view of the device shown in FIG. 1.

With reference to FIGS. 2–4, a receptacle 104 for receiving and supporting shredded material discharged from the shredder 28 is selectively supportable by and positionable within the file drawer 52. The file drawer 52 includes a retaining member 108 extending across an interior of the file drawer 52. The receptacle 104 is positionable between a rear surface 112 of the file drawer 52 and the retaining member 108 to inhibit sliding of the receptacle 104 within the file drawer 52 when the file drawer 52 is moving between the open and closed positions. The receptacle 104 includes a front surface 116, a rear surface 120, a bottom surface 124 and two side surfaces 128 which together define a cavity 132 for receiving the shredded material discharged from the shredder 28. In the illustrated construction, the rear surface 120 has a height less than the heights of the other surfaces 116, 128 (discussed below).

With continued reference to FIGS. 2–4, the cabinet housing 32 supports a chute 136 for guiding shredded materials from the outlet to the receptacle 104. In the illustrated construction, the chute 136 is bonded to an underside of the top 44 of the cabinet housing 32 and is disposed around the aperture 68 defined in the top 44 of the cabinet housing 32 to surround the lower housing portion 84 of the shredder housing 76 when the shredder 28 is supported by the cabinet housing 32. In other constructions, the chute 136 may be selectively connectable to or integrally formed with the underside of the top 44 of the cabinet housing 32. The chute 136 is partially frusto-conically shaped and converges as the chute 136 extends downwardly to guide the shredded material toward the receptacle 104. It should be understood that the chute 136 can be configured in any appropriate manner to guide the shredded materials toward the receptacle 104 and still be within the spirit and scope of the present invention.

With particular reference to FIGS. 2 and 3, the height of the rear surface 120 of the receptacle 104 is less than the height of the other receptacle surfaces 116, 128 to allow the receptacle 104 to move underneath and out from underneath a bottom surface or bottom edge 140 of the chute 136 without interfering with the chute 136 as the file drawer 52 moves between the open and closed positions. The bottom edge 140 of the chute 136 extends below the front and two side surfaces 116, 128 of the receptacle 104 to inhibit shredded materials from missing the receptacle 104 and landing either in the file drawer 52 or missing the receptacle 104 and file drawer 52 altogether. In some constructions, the height of all receptacle surfaces, including the rear surface, are substantially the same and the bottom edge 140 of the chute 136 is positioned above all the receptacle surfaces to enable the receptacle 104 to move underneath and out from underneath the chute 136 without interference. In such constructions, the bottom edge 140 of the chute 136 does not extend into the cavity of the receptacle 104. In other constructions, the rear surface 120 of the receptacle 104 includes a movable portion (not shown) that engages the chute 136 and moves to allow the receptacle 104 to move underneath and out from underneath the chute 136 and returns to its original position after disengaging the chute 136. In such constructions, the bottom edge 140 of the chute 136 is surrounded on all sides when the receptacle 104 is positioned underneath the chute 136.

With continued reference to FIGS. 2 and 3, the drawers 52, 56 are sufficiently sized to perform their function and to accommodate the combination of the shredder 28 with the file cabinet 24. Particularly, the file drawer 52 has a depth in the direction from the front 36 to the rear 40 sufficient to position the receptacle 104 underneath the outlet and the chute 136. The file drawer 52 is also capable of supporting files 66 in front of the receptacle 104. The smaller drawers 56 have a depth in the direction from the front 36 to the rear 40 sufficiently sized to prevent interference with the chute 136 and the shredded materials discharged from the outlet. If the smaller drawers 56 had a depth similar to the depth of the file drawer 52, the smaller drawers 56 would engage the chute 136 and the drawers 56 would not be able to fully close. Accordingly, the depth of the smaller drawers 56 is less than the depth of the file drawer 52.

Now that the components of the combination file cabinet 24 and shredder 28 have been described, operation of the combination file cabinet 24 and shredder 28 will be described hereinafter.

With reference to FIG. 4, a user inserts the shredder 28 into the aperture 68 until the flange 88 rest upon the top of the cabinet housing 32, at which point the shredder 28 is supported by the file cabinet 24. A user moves the file drawer 52 to the open position and inserts the receptacle 104 into the file drawer 52 between the retaining member 108 and the rear surface 112 of the file drawer 52. The user then moves the file drawer 52 to the closed position to position the receptacle 104 underneath the outlet and the chute 136.

Materials can be fed into the inlet 92 of the shredder 28, shredded and discharged from the outlet into the chute 136, which guides the shredded material to the receptacle 104. It is preferable that the file drawer 52 is in the closed position during shredding operations, otherwise the shredded material will miss the receptacle 104 and fall onto the floor or the bottom of the file cabinet 24. However, the file drawer 52 may be moved between the open and closed positions as frequently as is desired to access the files 66 supported in the file drawer 52 as long as shredding operations are not occurring. To empty the receptacle 104, the file drawer 52 is moved from the closed position to the open position and a user grasps and removes the receptacle 104 from the file drawer 52. The receptacle 104 is emptied and returned to the file drawer 52 for further shredding operations.

In some constructions, the device includes a mechanical, electrical, magnetic or pneumatic switch (not shown) appropriately connected to the shredder 28 to allow the shredder 28 to operate only when the file drawer 52 is in the closed position. In such constructions, the switch is operable to determine whether the file drawer 52 is in the closed position or the open position.

The foregoing detailed description describes only a few of the many forms that the present invention can take, and should therefore be taken as illustrative rather than limiting. It is only the claims, including all equivalents, that are intended to define the scope of the invention.

I claim:

1. A combination comprising:

a cabinet including a cabinet housing having a top, a front, a back and two sides;

a first drawer supportable by the cabinet housing and operable to selectively support materials therein, the first drawer being movable between an open position and a closed position;

a second drawer supported by the cabinet housing to selectively support materials therein, the second drawer being movable between an open position and a closed position;

a shredder supported by the cabinet housing, the shredder being at least partially positioned within the cabinet housing and the shredder including an inlet for materials to be fed into the shredder to be shredded to form shredded material, wherein the inlet is accessible externally of the cabinet housing, an outlet through which shredded material is dispensed; and a receptacle selectively supported by and positioned within the first drawer for receiving shredded material from the outlet, the receptacle being positionable internally of the cabinet housing and underneath the outlet when the first drawer is in the closed position and being accessible and removable from the first drawer when the first drawer is in the open position.

2. The combination of claim 1, wherein the shredder is supported by the top of the cabinet housing.

3. The combination of claim 2, wherein the shredder includes a flange which engages the top of the cabinet housing.

4. The combination of claim 1, wherein the outlet is oriented internally of the cabinet housing and shredded material is dispensed into the cabinet housing.

5. The combination of claim 1, wherein the cabinet is a file cabinet.

6. The combination of claim 1, wherein the shredder is supported by a rearward portion of the top of the cabinet housing.

7. A combination comprising:

a cabinet including a cabinet housing having a top, a front, a rear and two sides, a shredder support in the top of the cabinet housing, a file drawer supported by the cabinet housing and operable to support files therein, the drawer being movable between a closed position and an open position; and a shredder including a shredder housing supported by the shredder support in the top of the cabinet housing, the top of the cabinet housing having a first depth in the direction from the front to the rear and the shredder housing having a second depth in the direction from the front to the rear, the first depth being at least two times the second depth, an inlet defined in the shredder housing, and an outlet defined in the shredder housing, the outlet opening discharging shredded material into the cabinet housing.

8. The combination of claim 7, wherein the shredder housing is positioned closer to the rear of the cabinet than to the front of the cabinet.

9. The combination of claim 7, further comprising a receptacle supportable by and at least partially positionable within the file drawer for receiving shredded materials discharged from outlet of the shredder and a chute supported by the cabinet housing and being at least partially positioned between the outlet and the receptacle for guiding shredded materials from the outlet to the receptacle.

10. The combination of claim 9, wherein the cabinet further comprises a second drawer positioned above the file drawer, the file drawer having a first drawer depth in the direction from the front to the rear sufficiently sized to position the receptacle at least partially underneath the chute when the file drawer is in the closed position, the second drawer having a second drawer depth in the direction from the front to the rear less than the first drawer depth and sufficiently sized to prevent interference of the second drawer with the shredder and the chute.

11. The combination of claim 9, wherein the receptacle is positionable underneath the chute when the file drawer is in the closed position and is removable from the file drawer when the file drawer is in the open position, and wherein the receptacle includes a bottom surface, a rear wall, a front wall and two side walls, at least the rear wall of the receptacle having a height sufficiently sized to position the rear wall lower than a bottom surface of the chute when the receptacle is positioned in the file drawer to allow the receptacle to move underneath and out from underneath the chute without substantial interference between the chute and the receptacle as the file drawer moves between the closed and open positions.

12. The combination of claim 7, wherein the cabinet is a file cabinet.

13. A combination comprising:

a cabinet including a cabinet housing having a top, a rear surface and two side surfaces, and a drawer supported by the cabinet housing and being movable between a closed position, in which the drawer is positioned substantially within the cabinet housing, and an open position, in which the drawer is positioned substantially outside the cabinet housing;

a shredder supportable by the cabinet housing and including a shredder housing, an inlet defined in the shredder housing for feeding materials into the shredder to be shredded, and an outlet defined in the shredder housing from which materials are discharged after being shredded, the outlet being positioned internally of the cabinet housing; and a receptacle supportable by the drawer for receiving material shredded by the shredder, the receptacle being positioned substantially underneath the outlet when the drawer is in the closed position and not being positioned underneath the outlet when the drawer is in the open position.

14. The combination of claim 13, wherein the receptacle is positioned substantially within the drawer, the receptacle being selectively removable from the drawer when the drawer is in the open position, and the receptacle not being removable from the drawer when the drawer is in the closed position.

15. The combination of claim 14, wherein the drawer further comprises a retaining member extending across an interior of the drawer in front of the receptacle in a position that the receptacle is engagable therewith, the retaining member inhibiting sliding of the receptacle within the drawer when the drawer is moved between the open and closed positions.

16. The combination of claim 15, wherein the drawer includes a rear surface, the receptacle being positioned between the rear surface of the drawer and the retaining member to inhibit sliding of the receptacle within the drawer.

17. The combination of claim 13, further comprising a chute connected to the cabinet housing and being at least partially positioned between the outlet of the shredder and the receptacle to guide shredded materials from the outlet to the receptacle.

18. The combination of claim 17, wherein the chute is shaped frusto-conically.

19. The combination of claim 17, wherein the chute is bonded to the top surface of the cabinet.

20. The combination of claim 13, wherein the drawer is a first drawer having a first depth in the direction from the front to the rear, the cabinet further comprising a second drawer having a second depth in the direction from the front to the rear less than the first depth, the second drawer being movable between an open position and a closed position and the second drawer being positioned above the first drawer, the firth depth being sufficiently sized to position the receptacle underneath the outlet when the first drawer is in the closed position, the second depth being sufficiently sized to prevent the second drawer form obstructing passage of shredded material from the outlet to the receptacle when the second drawer is in the closed position.

21. The combination of claim 13, wherein the cabinet is a file cabinet.

* * * * *